United States Patent [19]

Batliwalla

[11] 4,242,573

[45] Dec. 30, 1980

[54] WATER IMMERSIBLE HEATER

[75] Inventor: Neville S. Batliwalla, Foster City, Calif.

[73] Assignee: Raychem Corporation, Menlo Park, Calif.

[21] Appl. No.: 6,188

[22] Filed: Jan. 24, 1979

[51] Int. Cl.[3] ..... H05B 3/34

[52] U.S. Cl. ..... 219/528; 219/504; 219/544; 219/549; 219/553; 252/511; 264/105; 338/22 R; 338/214

[58] Field of Search ..... 219/345, 504, 565, 523, 219/528, 530, 535, 544, 549, 552, 553; 5/284; 338/22 R, 22 SD, 212, 214; 264/105, 346; 29/611; 156/85, 215; 174/124 R; 252/502, 511; 165/104 F

[56] References Cited

U.S. PATENT DOCUMENTS

| | | | |
|---|---|---|---|
| 2,529,914 | 11/1950 | Chauenner | 338/214 |
| 2,790,053 | 4/1957 | Peterson | 338/214 X |
| 3,657,520 | 4/1972 | Ragault | 219/553 |
| 3,790,753 | 2/1974 | Miller | 219/528 |
| 3,823,217 | 7/1974 | Kampe | 264/105 |
| 3,858,144 | 12/1974 | Bedard et al. | 338/22 R |
| 3,859,504 | 1/1975 | Motokawa et al. | 219/345 |
| 3,861,029 | 1/1975 | Smith-Johannsen et al. | 29/611 |
| 3,914,363 | 10/1975 | Bedard et al. | 264/105 |
| 4,074,222 | 2/1978 | Kiyokawa et al. | 338/212 |
| 4,118,260 | 10/1978 | Boettcher | 156/85 |

FOREIGN PATENT DOCUMENTS

| | | | |
|---|---|---|---|
| 1482918 | 8/1977 | United Kingdom | 156/85 |

*Primary Examiner*—Volodymyr Y. Mayewsky
*Attorney, Agent, or Firm*—Lyon & Lyon

[57] ABSTRACT

A heater immersible in liquids such as water suitable for water beds and a method for producing the heater are disclosed. The heater includes two-spaced apart metallic electrodes interconnected by a conductive polymeric matrix. A water-impermable barrier completely surrounds the polymeric matrix. A jacket of plasticized polyvinyl chloride can be placed around the barrier. The barrier also prevents plasticizer from the polyvinyl chloride from penetrating and damaging the conductive polymeric matrix.

8 Claims, 5 Drawing Figures

FIG. 5
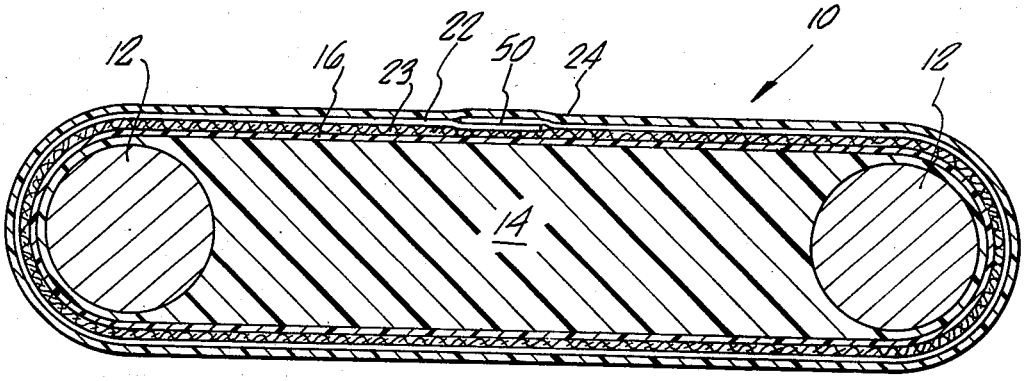
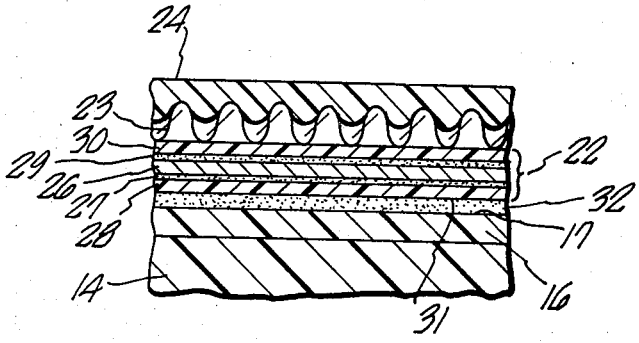
FIG. 3
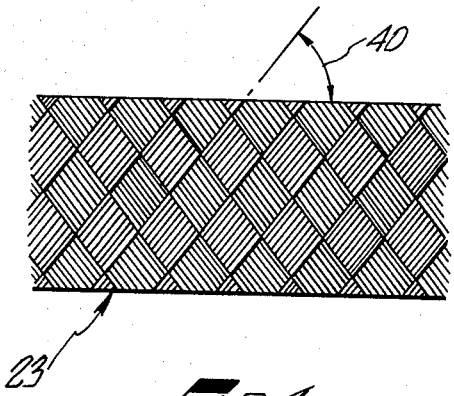
FIG. 4

WATER IMMERSIBLE HEATER

BACKGROUND OF THE INVENTION

This invention relates to electrically conductive, temperature self-limiting heaters.

Conventional water bed heaters are unsatisfactory for a variety of reasons. These heaters usually comprise an area heater connected to an appropriate temperature controller and power source. The area heater is placed against the bottom of the water bed mattress. The heat generated by the area heater is transferred through the polyvinyl chloride mattress and into the water in the mattress.

Although such heaters have been found to be satisfactory in practice, they are not without disadvantages. For example, the hot heater tends to degrade the mattress where it is in direct contact with the mattress, thereby shortening the life of the water bed mattress. Under some circumstances, it is possible for the water bed to burst at the point of degradation. Another disadvantage arises if the mattress is inadequately filled with water. The area heater can then overheat. If the mattress bottoms out on the heater, this can result in a person sleeping on the mattress being burned. A third disadvantage is that it is inherently less efficient to heat water through a thick plastic layer than it would be to heat the water directly.

These disadvantages can be overcome with a heater which is immersible in water. Unfortunately, there is no flexible, temperature self-limiting, water-immersible heater available for water beds.

It has been suggested to directly immerse in water electrically conductive heaters such as those described in U.S. Pat. Nos. 3,823,217; 3,858,144; 3,861,029; and 3,914,363, in copending and coassigned U.S. patent application Ser. Nos. 869,786 filed by Kampe on Jan. 16, 1978; 750,149 filed by Kamath et al on Dec. 13, 1976, now abandoned; and 947,554 filed by Kamath et al on Oct. 2, 1978. Each of these four patents and each of these two patent applications are incorporated herein by this reference. Such heaters have found many commercial applications. For example, they have been disposed along pipes to either prevent fluids contained therein from freezing or to maintain the temperature of such fluids at some preselected temperature. Further, such heaters have been embedded in pavement materials to keep the surface of such pavement free from ice and snow.

Useful as such prior art heaters are, they unfortunately suffer from a number of disadvantages which make them unsuitable for applications in which they would be subjected to continuous immersion in water or other liquids. For example, such heaters can be permanently damaged by moisture or certain polymer additives which can diffuse into an immersed heater. Therefore, these prior art heaters are unsuitable for heating water beds by immersion in the water. Thus, there is a need for a flexible, temperature self-limiting, water immersible heater suitable for water beds.

SUMMARY OF THE INVENTION

This invention is directed to flexible, electrically conductive, temperature self-limiting, water immersible heaters which can be used for directly heating liquids such as water, including water contained in a water bed mattress. The heater comprises at least two spaced apart metallic electrodes interconnected by a conductive polymeric matrix. To prevent both water and polymer additives from reaching the matrix, the conductive composition is surrounded by an impermeable barrier. Preferably the barrier is flexible and corrosion resistant. In the case of a water bed heater, preferably the barrier is impermeable to plasticizers which diffuse into the water from the plastic from which the water bed mattress is made. A preferred barrier comprises a layer of aluminum sandwiched between and bonded to two sheets of polyester film, one of which sheets is provided with a layer of heat-activatible adhesive on its exterior surface.

When the heater is used for heating a water bed, a grounding element is required, where the grounding element has sufficient flexibility that it remains intact in spite of abuse it might receive in the water bed. A preferred grounding element is a braid insulated from the conductive composition by a polyurethane layer. Preferably, the braid is disposed around the water impermeable barrier which surrounds the polyurethane layer. The barrier is wrapped tightly around the polyurethane layer with a pair of progressive wrap forming dies. The second die is heated to activate the adhesive so that an exterior surface portion of one of the polyester sheets bonds to an exterior surface portion of the other sheet in a linear overlap region.

DRAWINGS

These and other features, aspects, and advantages of the present invention will become better understood with reference to the following description, appended claims, and accompanying drawings, which are not drawn to scale where:

FIG. 3 shows in detail in cross-section, the water impermeable barrier of the heater of FIG. 1 in the region 3 of FIG. 2;

FIG. 4 is an overhead view of the braid of the heater of FIG. 1; and

FIG. 5 is a cross-section end-on-view of an alternate heater according to the present invention.

DESCRIPTION

The present invention is directed to an improvement over the heaters described in the aforementioned patents and patent applications. This improvement permits such heaters to be directly immersed in bodies of water. Although the improved heaters according to present invention are described herein primarily for use with water beds and for heating water, other applications of these heaters are possible. For example, the heaters can be used in aquariums and can be used industrially in water tanks to maintain the water at a selected temperature and/or to prevent ice formation on the water. Also, the improved heater can be used with liquids other than water.

Figure 1:
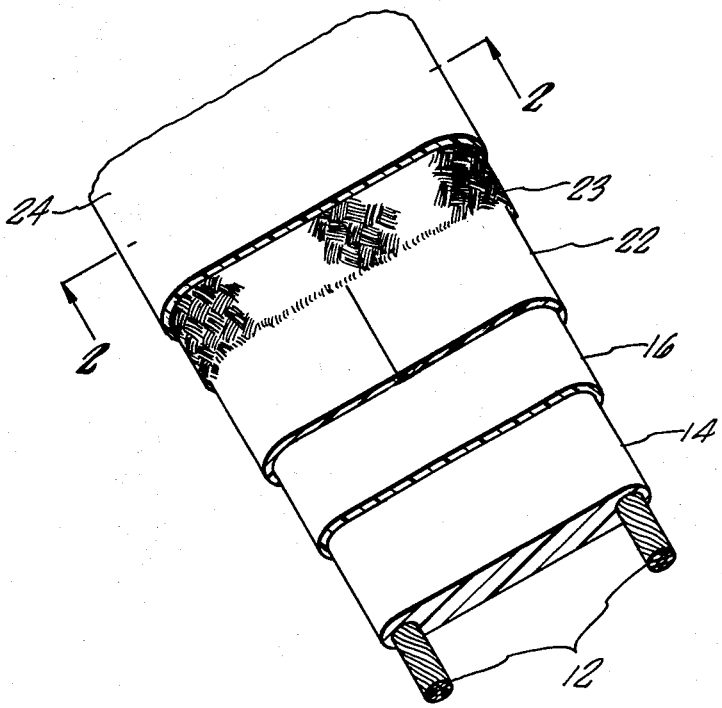
FIG. 1 is a perspective view of a heater according to the present invention.

With reference to FIG. 1, a heater according to the present invention comprises:

two spaced apart metallic electrodes 12;

an electrically conductive polymeric composition 14 interconnecting the electrodes 12;

an electrically insulating prejacket 16 around the conductive composition 14;

a water impermeable barrier 22 around the insulating prejacket 16;

an electrically conductive grounding element 23 around the water impermeable barrier 22; and an outer jacket 24 of insulating material.

Each component of the heater will be discussed in detail.

Preferred materials for the electrodes 12 include tin-plated copper, nickle-plated copper and silver-plated copper. The electrodes can vary in configuration, being flat, solid, stranded, round, etc. The preferred electrodes are round, tin-plated, 18 gauge stranded copper wire.

The conductive composition 14 comprises conductive particulate material such as carbon black dispersed in a polymeric matrix. The particular composition 14 can be any of those described in the aforementioned patents and patent applications. When a heater is used for a water bed, preferably the conductive composition 14 is chosen so that the heater is temperature self-limiting so that substantially no heat is generated when the temperature of the water of the water bed reaches a temperature which can be a safety hazard, i.e., preferably the conductive material is chosen so that substantially no heat can be generated when the water in the water bed reaches a temperature of about 150° F.

As shown in FIG. 1, preferably a heater having a substantially flat, rectangular shaped cross-section such as described in U.S. patent application Ser. No. 608,660 is used.

A preferred conductive compound for water bed heaters comprises medium density polyethylene containing from about 5 to about 25%, and more preferably from about 9 to about 15% by weight carbon black, based on the total weight of the conductive compound.

The amount of conductive component per unit length of the heater depends on the amount of heat that is desired to be generated per unit length of the heater. In a preferred version, about 9.6 pounds of conductive material per 1,000 feet of heater are used.

The conductive material 14 is insulated from the grounding element 23 by means of the insulating prejacket 16. Preferably the insulating material is made from a polyester or polyether based extrusion grade polyurethane, such as CPR 2102-550 manufactured by the Upjohn Company, Kalamazoo, Michigan. The insulating prejacket is preferably made of a material which contains no plasticizers, so plasticizer contamination of the conductive material 14 does not occur. The thickness of the polyurethane prejacket 16 can be from about 8 to about 12 mils, and preferably is about 10 mils.

A key feature of the heater shown is the water impermeable barrier 22 on top of the polyurethane prejacket 16. It is necessary that this barrier have substantially zero water vapor and moisture transmission. Preferably the barrier is also flexible and resistant to corrosion. More preferably the barrier is also impermeable to any plasticizer in the outer jacket 24 of the heater and any plasticizers in the water in the water bed leached out of the polyvinyl chloride used for fabricating the water bed mattress.

A preferred barrier 22 comprises a flat strip of aluminum 26 sandwiched and bonded between two sheets of polyester film 28 and 30 such as the film sold by duPont under the tradename Mylar. The aluminum is bonded to the Mylar by means of a polyester based adhesive 27 and 29, such as Catalog No. 46983 available from duPont with RC-803 curing agent from duPont added to render the adhesive thermosetting. The aluminum serves as a moisture and plasticizer barrier. The polyester film also serves as a moisture and plasticizer barrier, but to a lesser extent than the aluminum. The main functions of the polyester sheets are: to protect the aluminum from corrosion; to provide a substrate to which the outer jacket 24 can be bonded; and to enhance the tensile strength and tear resistance of the aluminum strip 26, thereby facilitating the roll forming and hot bonding of the barrier 22 around the prejacket 16 and the extrusion of the outer jacket 24 over the remainder of the heater 10.

If the thickness of each polyester sheet is greater than about 2 mils and if the thickness of the aluminum strip is greater than about 2 mils, the heater is too rigid for use in a water bed. Furthermore, increased thickness means increased cost. If the polyester film is less than about 0.2 mils thick and if the aluminum is less than about 0.5 mils thick, there is a significant chance of a pin hole or thin spot. Therefore, for maximum strength, flexibility, and moisture impenetrability, preferably each layer of polyester film is about 0.2 to 2 mils thick and the aluminum is from about 0.5 to about 2 mils thick. Most preferably, each sheet of polyester film is about 0.5 mil thick and the aluminum strip is about 1 mil thick. The preferred type of aluminum is type 1145.

In addition to polyester film and aluminum, the barrier can be other suitable combinations of materials such as polyester film and copper, polyethylene and copper, polypropylene and copper, polyethylene and aluminum, and polypropylene and aluminum. The barrier can also be a single layer of a single type of material that is flexible and water impermeable such as nickle-plated copper.

Preferably the interior surface 31 of the barrier 22 has an adhesive layer 32 disposed thereupon so that the barrier 22 can be permanently secured to the outer surface 17 of the polyurethane prejacket 16. Preferably the adhesive 32 is heat activatable, such as a hot-melt adhesive. By using a hot-melt adhesive, adhesion is not a problem during the fabrication and handling of the barrier, but when the barrier 22 is tightly wrap formed around the prejacket 16, by the heated die, the adhesive is activated.

The adhesive 32 used can be any adhesive suitable for bonding both polyester film to itself and to polyurethane. Preferred adhesives are polyester based adhesives such as No. 46983 manufactured by duPont. The adhesive 32 preferably is disposed on the interior surface 31 of the barrier 22 in a thickness of from about 0.1 to about 1.0 mil, and more preferably in a thickness of from about 0.2 to about 0.5 mil.

As shown in FIG. 1, preferably the barrier 22 overlaps itself in the region 50. Because of this overlap, upon activation of the adhesive 32, the barrier bonds to itself. This assures that the barrier remains in place during manufacture and subsequent use of the heater.

When the heater is used for water bed mattresses, for safety purposes, preferably the grounding element 23 has sufficient flexibility that it does not break in use. According to Underwriters Laboratories, Inc. of Santa Clara, California, to be certain of the reliability of the heater, it is necessary that the heater be able to withstand 5,000 cycles of flexing over a ½-inch diameter mandrel through an angle of 180° at a rate of 40 cycles per minute without breaking the grounding element strands. A grounding element that satisfies this test is shown in FIG. 4. The grounding element comprises braid 23 longitudinally disposed over the barrier 22. The braid 23 is woven using 16 bobbins, each bobbin having seven strands of 34 gauge tinned copper wire. The braid is woven at a braid angle 40 of at least 50°, and preferably at about 52°. The resultant braid 23 has a current carrying capacity equivalent to about 14 gauge wire. It has been found that if the braid is wrapped at an angle less than about 50°, or if wire smaller than about 36 gauge is used, the resultant grounding element does not meet the Underwriters Laboratories, Inc.'s flexibility requirements. It is preferred that there is at least 80% coverage of the barrier 22 by the overlying braid 23.

It is believed that conductors other than tinned copper wire can be used to form the grounding element. Examples of other conductors are copper, and nickle and silver-plated copper.

The outer insulating jacket 24 can be made of any electrically non-conductive, flexible material. Preferably it is polyvinyl chloride in a thickness of from about 15 to about 50 mils, more preferably from about 20 to about 25 mils, and most preferably about 22 mils. A preferred polyvinyl chloride is grade 855 made by Teknor Apex.

As shown in FIG. 5, in an alternate version of the present invention, the barrier 22 can be around the grounding element 23. However, preferably the grounding element 23 is around the water impermeable barrier because when the water impermeable barrier is around the braided grounding element 23, air pockets are left in the interstices of the braid. These air pockets adversely affect transmission of heat from the conductive composition 14 to water. With the braid around the barrier, the polyvinyl chloride outer jacket 24 fills in the interstices of the braid, resulting in greatly reduced air gaps. It has been found that a heater with the braid around the barrier is 5 to 20% more efficient in heating water than a comparable heater with the barrier wrapped around the braid because of the air gaps of the latter.

A heater made in accordance with the parameters presented above exhibits excellent performance characteristics. It is sufficiently flexible for use in water bed mattresses, and resists germicides such as trimethyl/-benzyl ammonium chloride used in water bed mattresses. Furthermore, the heater can be subjected to repeated flexing without damage to its grounding braid. In addition, repeated flexing does not damage the outer insulation 24 and the inner insulating prejacket 16.

There are significant advantages to be obtained by using an immersible heater according to the present invention in water beds. Among these advantages is that the heater can be cut to length for a different sized water bed mattress, depending upon the amount of heat required for the mattress. For example, shorter heaters can be provided for twin beds than for Queen and King sized beds. Another advantage is extended water bed life because there is no heater directly in contact with the exterior surface of the mattress. Thus, degradation of the polyvinyl chloride used for forming the mattress is avoided. Because there is no hot spot, it is less likely that the water bed would rupture due to degradation. In addition, because the heater is temperature self-limiting, even if a water bed mattress is inadequately filled, a user cannot be burned.

Another advantage is that more even and comfortable temperature control is obtained because the heater is immersed directly in the water in the mattress, and preferably at the bottom of the mattress. Thus, the water proximate to the person using the bed is at a substantially uniform temperature.

Another advantage is more efficient utilization of the heat generated by the heater. Ten to twenty percent savings in energy can be achieved because it is more efficient to directly heat water with an immersible heater, than to heat the water through a thick polyvinyl chloride mattress.

The heater 10 is formed by extruding the conductive material 14 around the two electrodes 12 and then extruding the polyurethane prejacket 16 over the conductive material 14. As described in the aforementioned application Ser. No. 750,149, the conductive composition can be extruded over the electrodes while they are at a temperature above the melting point of the composition.

Figure 2:
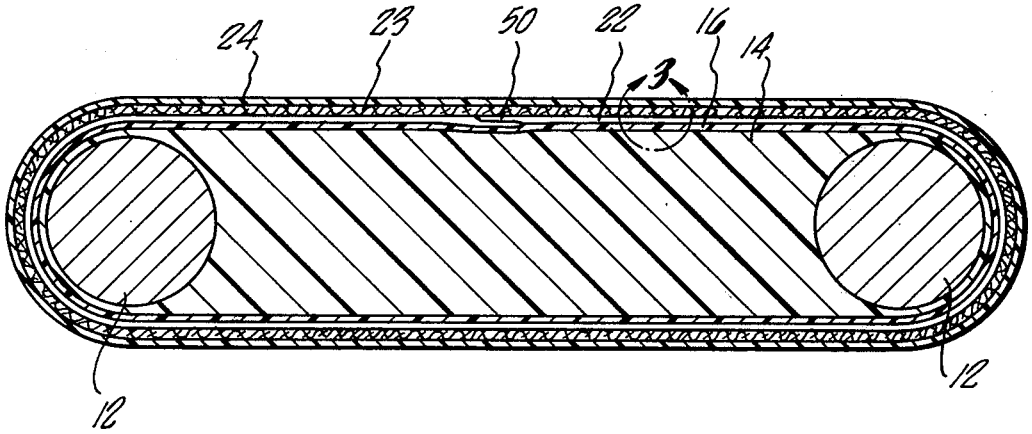
FIG. 2 is a cross-section end-on-view of the heater of FIG. 1 taken along line 2—2 in FIG. 1.

An important feature of the present invention is the preferred technique used for placing the water impermeable barrier 22 over the prejacket 16. Although the barrier 22 is flexible, it has sufficient thickness and rigidity that it is somewhat difficult to handle. Therefore, it has been found necessary to use a two-stage, progressive wrap forming process for securing the barrier around the prejacket 16. First, the barrier is wrapped around a sub-assembly which comprises the electrodes 12, the conductive material 14 and the prejacket 16. This is effected by bending the barrier 22 around the sub-assembly by means of a first tapered die. The tip of the die is substantially rectangular in shape, having a height of 0.15 inch and a width of 0.44 inch. The barrier 22 is wrapped so that it overlaps itself as shown by the region 50 in FIG. 2. The sub-assembly with the barrier thereupon is then passed through a second die, the tip of the second die being substantially rectangular and having a height of 0.15 inch and a width of 0.43 inch. The second die is heated to a temperature sufficient to activate the adhesive layer 32 on the interior surface of the barrier. For an adhesive that is activated at a temperature of about 300° F., the second die is heated to a temperature greater than 300° F. This results in the barrier being bonded to itself in the overlap region 50, thereby assuring that the barrier remains in place during further processing. The braid 23 is then woven around the barrier 22.

The last step of the process is to place the outer insulating jacket made of a thermoplastic material such as polyvinyl chloride over the braid 23. This is done using conventional extrusion techniques.

Although the present invention has been described in considerable detail with reference to certain preferred versions thereof, other versions of this invention are possible. For example, although the preferred method for manufacturing the heater 10 has been described in terms of placing the barrier layer 22 on a particular sub-assembly, the two die technique with a heated die is usable for practically any elongated substrate, where a flexible material is to be placed around the substrate. It is particularly useful when the flexible material has some rigidity such as the barrier described herein comprising a layer of aluminum sandwiched between two layers of polyester film.

Therefore, the spirit and scope of the appended should not necessarily be limited to the description of the preferred version contained herein.

What is claimed is:

1. A flexible, electrically conductive, temperature self-limiting heater suitable for immersion in water comprising:

(a) two spaced apart metallic electrodes;

(b) an electrically conductive polymeric composition interconnecting the electrodes;

(c) an electrically insulating prejacket around the polymeric composition;

(d) a flexible, corrosion resistant, electrically non-conductive, water impermeable barrier around the insulating prejacket, the barrier comprising an inner sheet of polyester film, a flat strip of aluminum, and an outer sheet of polyester film;

(e) an electrically conductive grounding braid around the barrier; and (f) an electrically insulating polymeric outer jacket.

2. The heater of claim 1 in which the inner surface of the barrier has an adhesive layer upon it for bonding the inner surface of the barrier to the outer surface of the insulating prejacket.

3. The heater of claim 2 in which the barrier is placed around the insulating prejacket such that the barrier overlaps itself and bonds to itself.

4. The heater of claim 1 in which the aluminum strip has a thickness of about 1 mil and each sheet of polyester film has a thickness of about ½ mil.

5. The heater of claim 1 in which the braid comprises about 16 bobbins, each bobbin comprising about 7 strips of 34 gauge wire.

6. The heater of claim 5 in which the braid is longitudinally wrapped around the barrier at a braid angle of at least about 50°.

7. The heater of claim 1 in which the prejacket is made of polyurethane.

8. The heater of claim 1 or 7 in which the outer jacket is made of plasticized polyvinyl chloride.

* * * * *